US008188959B2

(12) United States Patent
Chen

(10) Patent No.: US 8,188,959 B2
(45) Date of Patent: May 29, 2012

(54) LIQUID CRYSTAL DISPLAY EXHIBITING LESS FLICKER AND METHOD FOR DRIVING SAME

(75) Inventor: Eddy Giing-Lii Chen, Miao-Li (TW)

(73) Assignee: Chimei Innolux Corporation, Miaoli County (TW)

( * ) Notice: Subject to any disclaimer, the term of this patent is extended or adjusted under 35 U.S.C. 154(b) by 1172 days.

(21) Appl. No.: 12/008,761

(22) Filed: Jan. 14, 2008

(65) Prior Publication Data

US 2008/0170021 A1 Jul. 17, 2008

(30) Foreign Application Priority Data

Jan. 12, 2007 (CN) ..... 2007 1 0072942

(51) Int. Cl.
*G09G 3/36* (2006.01)

(52) U.S. Cl. ..... 345/89; 345/98; 345/99; 345/100; 345/102

(58) Field of Classification Search ..... 345/76, 345/77, 87–103, 204, 211, 212, 213, 214, 345/545, 549, 690, 32, 581; 348/372; 382/168; 349/37, 61

See application file for complete search history.

(56) References Cited

U.S. PATENT DOCUMENTS 5,663,772 A * 9/1997 Uehara et al. ..... 348/671
5,677,704 A * 10/1997 Kusano et al. ..... 345/89
5,754,186 A * 5/1998 Tam et al. ..... 345/629
5,774,101 A 6/1998 Hirai et al.
5,900,886 A * 5/1999 Shay ..... 345/691
5,953,002 A * 9/1999 Hirai et al. ..... 345/204
6,353,435 B2 * 3/2002 Kudo et al. ..... 345/204
6,738,054 B1 5/2004 Yamaguchi
6,862,021 B2 * 3/2005 Kudo et al. ..... 345/204
7,283,105 B2 * 10/2007 Dallas et al. ..... 345/32
7,538,749 B2 * 5/2009 Chung et al. ..... 345/77
7,729,022 B2 * 6/2010 Jou et al. ..... 358/519
8,026,884 B2 * 9/2011 Hsieh et al. ..... 345/89
2001/0028346 A1 * 10/2001 Kudo et al. ..... 345/204
2001/0033262 A1 * 10/2001 Funakoshi et al. ..... 345/89
2002/0130881 A1 * 9/2002 Kudo et al. ..... 345/581
2003/0156086 A1 * 8/2003 Maeda et al. ..... 345/89
2003/0184508 A1 * 10/2003 Lee ..... 345/87
2005/0007334 A1 * 1/2005 Park ..... 345/102
2005/0195144 A1 * 9/2005 Kwon et al. ..... 345/89
2005/0243077 A1 * 11/2005 Chung et al. ..... 345/204
2005/0276088 A1 * 12/2005 Moon et al. ..... 365/63
2005/0276502 A1 * 12/2005 Brown Elliott et al. ..... 382/254
2006/0007249 A1 * 1/2006 Reddy et al. ..... 345/690
2006/0044242 A1 * 3/2006 Park et al. ..... 345/89
2006/0050045 A1 * 3/2006 Maruoka et al. ..... 345/99

(Continued)

*Primary Examiner* — Prabodh Dharia
(74) *Attorney, Agent, or Firm* — WPAT., P.C.; Justin King

(57) ABSTRACT

An exemplary liquid crystal display includes a frame buffer (41), a frame rate conversion circuit (42), a data divider (43), and a data driver (44). The frame buffer is configured for doubling a frame rate of inputted signals. The frame rate conversion circuit is configured for reducing a bit number of signals. The frame rate conversion circuit includes a first and a second look up table. The first look up table converts a gray level of one of the sub-frames into a higher gray level corresponding to signals with the lower bit number. The second look up table is configured for converting a gray level of the other sub-frame into a lower gray level corresponding to signals with the lower bit number. The data divider is configured for transmitting the signals to the data driver in several buses. The data driver drives the liquid crystal display to display images.

15 Claims, 2 Drawing Sheets

U.S. PATENT DOCUMENTS

2006/0139310 A1* 6/2006 Zehner et al. ..... 345/107
2006/0145979 A1* 7/2006 Lee et al. ..... 345/88
2006/0176529 A1* 8/2006 Ito et al. ..... 358/518
2006/0197987 A1* 9/2006 Kao et al. ..... 358/3.01
2007/0013627 A1* 1/2007 Hsieh et al. ..... 345/89
2007/0018934 A1* 1/2007 Kim et al. ..... 345/98
2007/0076019 A1* 4/2007 Randall ..... 345/691
2007/0171474 A1* 7/2007 Jou et al. ..... 358/3.01
2008/0231571 A1* 9/2008 Krijn et al. ..... 345/87

* cited by examiner

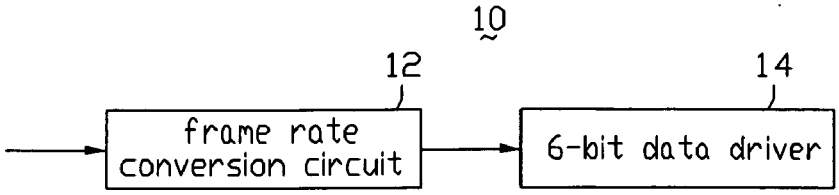
FIG. 3
(RELATED ART)
| first frame | | second frame | | third frame | | fourth frame | | |
|---|---|---|---|---|---|---|---|---|
| 4 | + | 4 | + | 4 | + | 4 | = | 4 |
| 4 | + | 4 | + | 4 | + | 8 | = | 5 |
| 8 | + | 4 | + | 8 | + | 4 | = | 6 |
| 4 | + | 8 | + | 8 | + | 8 | = | 7 |
| 8 | + | 8 | + | 8 | + | 8 | = | 8 |
FIG. 4
(RELATED ART)
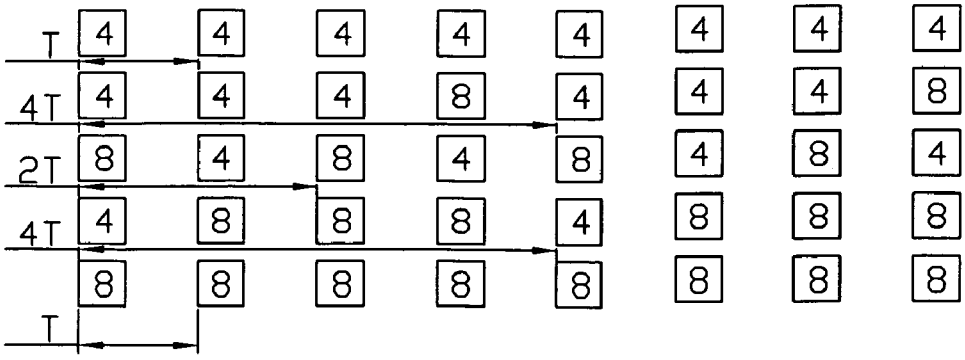
FIG. 5
(RELATED ART)

LIQUID CRYSTAL DISPLAY EXHIBITING LESS FLICKER AND METHOD FOR DRIVING SAME

CROSS-REFERENCE TO RELATED APPLICATION

This application is related to, and claims the benefit of, a foreign priority application filed in China as Serial No. 200710072942.0 on Jan. 12, 2007. The related application is incorporated herein by reference.

FIELD OF THE INVENTION

The present invention relates to a liquid crystal display configured with circuitry to enable displayed images to exhibit little or no flicker, and to a method for driving a liquid crystal display to display images having little or no flicker.

GENERAL BACKGROUND

Liquid crystal displays (LCDs) have advantages of portability, low power consumption, and low radiation. Therefore, LCDs are widely used in modern daily life. Typically, a color LCD displays images based on red (R), green (G), and blue (B) primary colors. In each of sub-pixel regions of the LCD, a respective one of the R, G, B colors is displayed. Each sub-pixel region can display the respective R, G, or B color in any one of a range of intensities called gray levels. Typically, there are 256 (8-bit) gray levels, which range from the $0^{th}$ gray level to the $255^{th}$ gray level. Each of the 8-bit gray levels corresponds to an 8-bit signal input to the LCD. An 8-bit data driver of the LCD receives the 8-bit signals for all the sub-pixel regions, and drives the LCD to display corresponding images. Thereby, the LCD can display images having as many as 16,777,216 (256×256×256) different colors.

However, due to cost issues, many or even most LCDs use a 6-bit data driver and a frame rate conversion (FRC) circuit. The 6-bit data driver and the FRC circuit cooperate to function as the equivalent of an 8-bit data driver. Referring to FIG. 3, this shows a conventional drive circuit 10 of an LCD. 8-bit input signals are converted into 6-bit signals by a frame rate conversion circuit 12. Each of the 6-bit signals represents one of 64 (6-bit) gray levels selected from the 8-bit gray levels. For example, the 6-bit gray levels may be the $0^{th}$, $4^{th}$, $8^{th}$, $12^{th}$, . . . , $248^{th}$, $252^{nd}$ gray levels selected from the 8-bit gray levels corresponding to the 8-bit signals. A 6-bit data driver 14 receives the 6-bit signals, and drives the LCD to display corresponding images.

FIG. 4 is a diagram illustrating how the frame rate conversion circuit 12 operates. Each sub-pixel region of the LCD displays 6-bit gray levels in four successive frames so as to simulate an 8-bit gray level. For example, the four successive frames are a first frame, a second frame, a third frame, and a fourth frame. If the sub-pixel region displays the $4^{th}$ gray level corresponding to a 6-bit signal in each of the first, second, and third frames, and displays the $8^{th}$ gray level corresponding to a 6-bit signal in the fourth frame, the $5^{th}$ gray level corresponding to an 8-bit signal is obtained as a visual effect. Similarly, if the sub-pixel region displays the $8^{th}$ gray level corresponding to a 6-bit signal in the first and third frames, and displays the $4^{th}$ gray level corresponding to a 6-bit signal in the second and fourth frames, the $6^{th}$ gray level corresponding to an 8-bit signal is obtained as a visual effect. If the sub-pixel region displays the $4^{th}$ gray level corresponding to a 6-bit signal in the first frame, and displays the $8^{th}$ gray level corresponding to a 6-bit signal in the second, third, and fourth frames, the $7^{th}$ gray level corresponding to an 8-bit signal is obtained as a visual effect. If the sub-pixel region displays the $4^{th}$ gray level corresponding to a 6-bit signal in each of the four successive frames, the $4^{th}$ gray level corresponding to an 8-bit signal is obtained as a visual effect. If the sub-pixel region displays the $8^{th}$ gray level corresponding to a 6-bit signal in each of the four successive frames, the $8^{th}$ gray level corresponding to an 8-bit signal is obtained as a visual effect. Thus, the 8-bit gray levels are obtained as a visual effect by displaying four successive 6-bit gray levels in a sub-pixel region.

However, if the 6-bit gray levels are periodically oscillated in a sub-pixel region, the LCD employing the frame rate conversion circuit 12 may have a side effect in that flickering may appear in the displayed images. When the LCD displays still images, the flickering is more obvious. As shown in FIG. 5, the frame rate of the LCD is 1/T. If the sub-pixel region displays the $4^{th}$ gray level in four successive frames, and this happens repeatedly, the flickering rate of the LCD is 1/T. If the sub-pixel region displays the $8^{th}$ gray level in four successive frames, and this happens repeatedly, the flickering rate of the LCD is also 1/T. If the sub-pixel region displays the $4^{th}$ gray level in the first, second, and third frames and displays the $8^{th}$ gray level in the fourth frame, and this happens repeatedly, the flickering rate of the LCD is 1/4T. If the sub-pixel region displays the $8^{th}$ gray level in the first and third frames and displays the $4^{th}$ gray level in the second and fourth frames, and this happens repeatedly, the flickering rate of the LCD is 1/2T. If the sub-pixel region displays the $4^{th}$ gray level in the first frame and displays the $8^{th}$ gray level in the second, third, and fourth frames, and this happens repeatedly, the flickering rate of the LCD is 1/4T.

The frame rate 1/T of the LCD is generally 60 hertz (Hz). Therefore, the flickering rate of the LCD may be 60 Hz, 30 Hz, or 15 Hz. If the flickering rate is 30 Hz or 15 Hz, the human eye can easily perceive the flickering of the images displayed by the LCD. In such cases, the display characteristics and performance of the LCD are reduced.

What is needed, therefore, is a liquid crystal display and a driving method for driving the liquid crystal display that can overcome the above-described deficiencies.

SUMMARY

A liquid crystal display includes a frame buffer, a frame rate conversion circuit, a data divider, and a data driver. The frame buffer is configured for doubling a frame rate of inputted signals by converting each frame into two sub-frames. The frame rate conversion circuit is configured for reducing a bit number of signals received from the frame buffer. The frame rate conversion circuit includes a first look up table and a second look up table. The first look up table is configured for converting a gray level of one of the sub-frames into a higher gray level. The higher gray level is corresponding to signals with a reduced bit number. The second look up table is configured for converting a gray level of the other sub-frame into a lower gray level. The lower gray level is corresponding to signals with the reduced bit number. The data divider is configured for receiving all the signals with the reduced bit number from the frame rate conversion circuit, and transmitting the signals to the data driver in a plurality of buses. The data driver is configured for driving the liquid crystal display to display images according to the signals received from the data divider.

A method for driving a liquid crystal display includes the following steps: doubling a frame rate of signals inputted to a frame buffer of the liquid crystal display by converting each frame into two sub-frames; reducing a bit number of corresponding signals received from the frame buffer by employing a first look up table and a second look up table, wherein the first look up table converts a gray level of one of the sub-frames into a higher gray level, the higher gray level corresponding to signals with a reduced bit number, and the second look up table converts a gray level of the other sub-frame into a lower gray level, the lower gray level corresponding to signals with the reduced bit number; dividing all the signals with the reduced bit number into a plurality of sets of signals, and transmitting the sets of signals in a plurality of buses respectively; and driving the liquid crystal display to display images according to the sets of signals.

Other novel features and advantages will become more apparent from the following detailed description when taken in conjunction with the accompanying drawings.

BRIEF DESCRIPTION OF THE DRAWINGS

FIG. 3 is a diagram of a drive circuit of a conventional LCD, the drive circuit including a frame rate conversion circuit.

FIG. 4 is a diagram illustrating how the frame rate conversion circuit of FIG. 3 operates.

FIG. 5 is a diagram illustrating how a flickering effect is generated in the LCD of FIG. 3.

DETAILED DESCRIPTION OF PREFERRED EMBODIMENTS

Reference will now be made to the drawings to describe the preferred and exemplary embodiments in detail.

Figure 1:
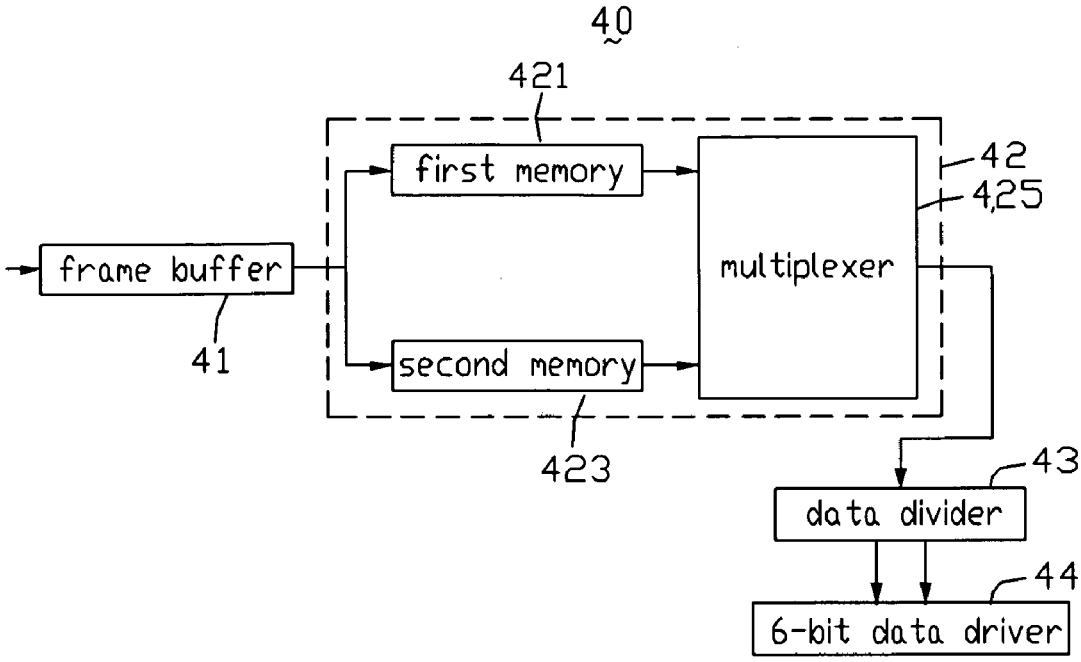
FIG. 1 is a diagram of a drive circuit of an LCD according to an exemplary embodiment of the present invention, wherein the LCD is capable of displaying a plurality of gray levels.

FIG. 1 is a diagram of a drive circuit of an LCD according to an exemplary embodiment of the present invention. The drive circuit 40 includes a frame buffer 41, a frame rate conversion circuit 42, a data divider 43, and a 6-bit data driver 44. The frame buffer 41 is configured for doubling the frame rate of input signals. Thereby, an input frame is converted into two output sub-frames by the frame buffer 41. The frame rate conversion circuit 42 is configured for converting 8-bit input signals into 6-bit output signals. The data divider 43 is configured for transmitting the 6-bit signals to the 6-bit data driver 44 in a plurality of buses. The 6-bit data driver 44 is configured for driving the LCD to display images according to the signals received from the data divider 43. In the illustrated embodiment, the data divider 43 transmits the 6-bit signals to the 6-bit data driver 44 in two buses (not labeled).

The frame rate conversion circuit 42 includes a first memory 421, a second memory 423, and a multiplexer 425. The first and second memories 421, 423 are coupled between the frame buffer 41 and the multiplexer 425, respectively. The first memory 421 includes a first look up table (LUT) for converting an 8-bit input signal into a 6-bit output signal. The second memory 423 includes a second look up table for converting the 8-bit input signal into another 6-bit output signal.

The first and second look up tables may be configured as follows. Typically, a gray level corresponding to a sub-pixel region of the LCD can be expressed by transmittance of light in the sub-pixel region. The relation between the gray level and the transmittance of light can be expressed according to the following equation:

$$L = \left(\frac{graylevel}{255}\right)^{\gamma} \tag{1}$$

where L represents the transmittance of light in the sub-pixel region, and γ represents a gamma value of the LCD (typically γ=2.2). Taking the $100^{th}$, $104^{th}$, and $102^{nd}$ gray levels as an example, the $104^{th}$ gray level corresponds to a transmittance L1 of light, which can be expressed according to the following equation:

$$L1 = \left(\frac{104}{255}\right)^{2.2} = 0.13902245 \tag{2}$$

The $100^{th}$ gray level corresponds to a transmittance L2 of light, which can be expressed according to the following equation:

$$L2 = \left(\frac{100}{255}\right)^{2.2} = 0.12752977 \tag{3}$$

The average value (mean) of the transmittances L1 and L2 is L3, which can be expressed according to the following equation:

$$L3 = \frac{L1 + L2}{2} = \frac{0.13902245 + 0.12752977}{2} = 0.1332761 \tag{4}$$

The $102^{nd}$ gray level corresponds to a transmittance L4 of light, which can be expressed according to the following equation:

$$L4 = \left(\frac{102}{255}\right)^{2.2} = 0.1332085 \tag{5}$$

According to the equations (4) and (5), the transmittance L4 corresponding to the $102^{nd}$ gray level is approximately equal to the average transmittance L3 corresponding to the $100^{th}$ and $104^{th}$ gray levels. Therefore the $102^{nd}$ gray level can be simulated by averaging the $100^{th}$ and $104^{th}$ gray levels, with a visual effect produced by the averaged gray levels being very similar to the visual effect of the gray level being simulated. A pair of numerals (102, 104) is stored in the first memory 421, and another pair of numerals (102, 100) is stored in the second memory 423. Among these numerals, 102 represents the $102^{nd}$ gray level corresponding to an 8-bit input signal, and 104, 100 respectively represent the $104^{th}$ and $100^{th}$ gray levels of two corresponding 6-bit output signals.

Taking the $128^{th}$, $60^{th}$, and $101^{st}$ gray levels as another example, the $128^{th}$ gray level corresponds to a transmittance L6 of light, which can be expressed according to the following equation:

$$L6 = \left(\frac{128}{255}\right)^{2.2} = 0.2195197 \quad (6)$$

The $60^{th}$ gray level corresponds to a transmittance L7 of light, which can be expressed according to the following equation:

$$L7 = \left(\frac{60}{255}\right)^{2.2} = 0.0414519 \quad (7)$$

The average value (mean) of the transmittances L6 and L7 is L8, which can be expressed according to the following equation:

$$L8 = \frac{L6 + L7}{2} = \frac{0.2195197 + 0.0414519}{2} = 0.1332761 \quad (8)$$

The $101^{st}$ gray level corresponds to a transmittance L9 of light, which can be expressed according to the following equation:

$$L9 = \left(\frac{101}{255}\right)^{2.2} = 0.1303523 \quad (9)$$

According to the equations (8) and (9), the transmittance L9 corresponding to the $101^{st}$ gray level is approximately equal to the average transmittance L8 corresponding to the $128^{th}$ and $60^{th}$ gray levels. A pair of numerals (101, 128) is stored in the first memory 421, and another pair of numerals (101, 60) is stored in the second memory 423. Among these numerals, 101 represents the $101^{st}$ gray level corresponding to an 8-bit input signal, and 128, 60 respectively represent the $128^{th}$ and $60^{th}$ gray levels of two corresponding 6-bit output signals.

Accordingly, using the equation (1), each of the 8-bit gray levels can be simulated by two corresponding 6-bit gray levels, as shown in TABLE 1 below.

TABLE 1

| 8-BIT GRAY LEVEL | FIRST 6-BIT GRAY LEVEL | FIRST GRAY LEVEL PAIR | SECOND 6-BIT GRAY LEVEL | SECOND GRAY LEVEL PAIR |
|---|---|---|---|---|
| 0 | 0 | (0, 0) | 0 | (0, 0) |
| 1 | 4 | (1, 4) | 0 | (1, 0) |
| 2 | 4 | (2, 4) | 4 | (2, 4) |
| 3 | 8 | (3, 8) | 0 | (3, 0) |
| 4 | 8 | (4, 8) | 4 | (4, 4) |
| 5 | 12 | (5, 12) | 0 | (5, 0) |
| 6 | 8 | (6, 8) | 8 | (6, 8) |
| 7 | 12 | (7, 12) | 4 | (7, 4) |
| 8 | 16 | (8, 16) | 0 | (8, 0) |
| 9 | 12 | (9, 12) | 8 | (9, 8) |
| 10 | 16 | (10, 16) | 4 | (10, 4) |
| ... | ... | ... | ... | ... |
| 101 | 128 | (101, 128) | 60 | (101, 60) |
| 102 | 104 | (102, 104) | 100 | (102, 100) |
| ... | ... | ... | ... | ... |
| 252 | 252 | (252, 252) | 252 | (252, 252) |
| 253 | 252 | (252, 252) | 252 | (252, 252) |
| 254 | 252 | (252, 252) | 252 | (252, 252) |
| 255 | 252 | (252, 252) | 252 | (252, 252) |

In the present embodiment, because the $252^{nd}$ gray level is the highest 6-bit gray level, each of the $253^{rd}$, $254^{th}$, and $255^{th}$ gray levels corresponding to 8-bit input signals cannot be simulated by any two corresponding 6-bit gray levels according to the equation (1). However, the intensity differences between the $252^{nd}$ gray level and any one of the $253^{rd}$, $254^{th}$, and $255^{th}$ gray levels cannot be easily perceived by the human eye. Therefore the $253^{rd}$, $254^{th}$, and $255^{th}$ gray levels corresponding to 8-bit input signals are simulated by two $252^{nd}$ gray levels corresponding to 6-bit output signals, as shown in TABLE 1. All the pairs of numerals in the "FIRST GRAY LEVEL PAIR" column of TABLE 1 form the first look up table. All the pairs of numerals in the "SECOND GRAY LEVEL PAIR" column of TABLE 1 form the second look up table.

The drive circuit 40 of the LCD can be operated by the following method. 8-bit signals are inputted into the frame buffer 41. In the present embodiment, the frame rate of the 8-bit signals is 60 Hz. The frame buffer 41 receives the 8-bit signals. In a frame period, each frame corresponding to the 8-bit signals is converted into a first sub-frame and a second sub-frame. Therefore, the frame buffer 41 outputs 8-bit signals having a frame rate of 120 Hz. In the present embodiment, the first and second sub-frames display the same image.

The first and second memories 421, 423 of the frame rate conversion circuit 42 receive the 8-bit signals converted by the frame buffer 41, respectively. The gray levels of the first and second sub-frames are respectively converted in the first and second memories 421, 423 via the first and second look up tables stored therein. Thereby, the 8-bit signals are converted into 6-bit signals. Taking the $102^{nd}$ gray level as an example, the $102^{nd}$ gray level of the first sub-frame is converted into the $104^{th}$ gray level via the gray level pair (102, 104) in the first look up table. The $102^{nd}$ gray level of the second sub-frame is converted into the $100^{th}$ gray level via the gray level pair (102, 100) in the second look up table.

Figure 2:
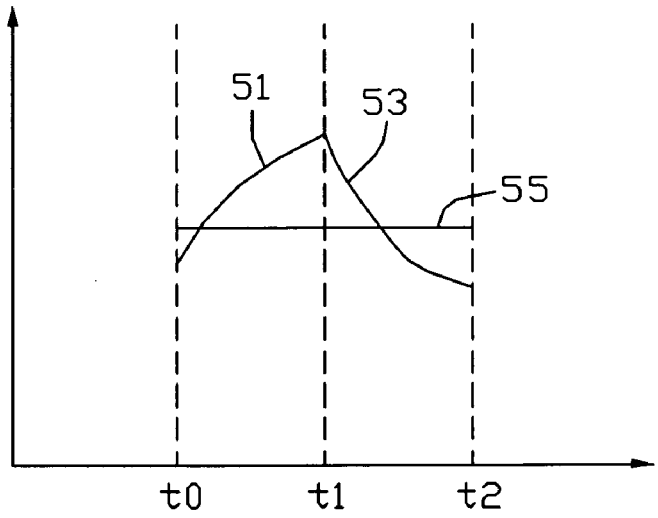
FIG. 2 is a graph showing luminance of three gray levels of the LCD of FIG. 1 over a period of time.

FIG. 2 is a graph showing luminance of the $100^{th}$, $102^{nd}$, and the $104^{th}$ gray levels of the LCD. The first curved line 51 represents a luminance of the $100^{th}$ gray level during the period from t0 to t1 (the first sub-frame). The second curved line 53 represents a luminance of the $104^{th}$ gray level during the period from t1 to t2 (the second sub-frame). The third straight line 55 represents a luminance of the $102^{nd}$ gray level during the period from t0 to t2 (the frame). The average luminance of the $100^{th}$ and $104^{th}$ gray levels perceived by the human eye during the period from t0 to t2 is approximately equal to the luminance of the $102^{nd}$ gray level. Therefore the $102^{nd}$ gray level corresponding to the 8-bit signals can be simulated by the $100^{th}$ and the $104^{th}$ gray levels corresponding to 6-bit signals, with the visual effect produced by the two gray levels corresponding to 6-bit signals being very similar to the visual effect of the gray level being simulated.

The multiplexer 425 receives the 6-bit signals converted by the first and second look up tables, and outputs the 6-bit signals to the data divider 43. The frame rate of the 6-bit signals outputted by the multiplexer 425 is 120 Hz. The data divider 43 receives the 6-bit signals, and divides the 6-bit signals into two sets of 6-bit signals. Therefore, the frame rate of each of the two sets of 6-bit signals is converted into 60 Hz. The two sets of 6-bit signals are transmitted to the 6-bit data driver 44 via the two buses (not labeled), respectively. The 6-bit data driver 44 receives the two sets of 6-bit signals, and drives the LCD to display images having a frame rate of 120 Hz.

As detailed above, each of the 8-bit gray levels is converted into two 6-bit gray levels in the frame rate conversion circuit 42. If the two 6-bit gray levels are the same, and this happens repeatedly, the flickering rate of the LCD employing the drive circuit 40 is 1/T, where 1/T represents the frame rate of signals outputted by the frame buffer 41. If the two 6-bit gray levels are different, and this happens repeatedly, the flickering rate of the LCD employing the drive circuit 40 is 1/2T. The frame buffer 41 converts a frame corresponding to 8-bit input signals into two sub-frames, thus the frame rate of the 8-bit output signals of the frame buffer 41 is improved to 120 Hz. That is, the flickering rate of the LCD is 120 Hz or 60 Hz, depending on whether the two 6-bit gray levels are the same or different. Because the human eye cannot easily perceive flickering when the flickering rate is higher than 50 Hz, the LCD employing the drive circuit 40 has improved display characteristics and performance.

Various modifications and alterations to the above-described embodiments are possible. The gray level pairs in the first and second look up tables may have other values. For example, the $102^{nd}$ gray level corresponding to an 8-bit signal may be simulated by the $124^{th}$ and $72^{nd}$ gray levels corresponding to 6-bit signals, with a visual effect produced by the two gray levels corresponding to 6-bit signals being very similar to the visual effect of the gray level being simulated. Thus, a gray level pair (102, 124) may be stored in the first look up table of the first memory 421, and another gray level pair (102, 74) may be stored in the second look up table of the second memory 423.

It is to be further understood that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid crystal display, comprising:

a frame buffer configured for doubling a frame rate of inputted signals by converting each frame into a first sub-frame and a second sub-frame;

a frame rate conversion circuit configured for reducing a bit number of signals received from the frame buffer, the frame rate conversion circuit comprising:

a first look up table configured for converting a gray level of one of the frames into a first predetermined gray level corresponding to the first sub-frame converted from said one frame, the first predetermined gray level corresponding to first signals with the reduced bit number; and a second look up table configured for converting the gray level of said one frame into a second predetermined gray level corresponding the second sub-frame converted from said one frame, the second predetermined gray level corresponding to second signals with the reduced bit number;

a data divider; and a data driver;

wherein the data divider is configured for receiving the first and second signals with the reduced bit number from the frame rate conversion circuit, and outputting third signals with a frequency being half of a frequency of the first signals and fourth signals with a frequency being half of a frequency of the second signals to the data driver; and the data driver is configured for driving the liquid crystal display to display images according to the third and fourth signals received from the data divider.

2. The liquid crystal display as claimed in claim 1, wherein the frame rate conversion circuit further comprises a multiplexer, and the multiplexer is configured to receive the first and second signals with the reduced bit number converted by the first and second look up tables, and output the first and second signals to the data divider.

3. The liquid crystal display as claimed in claim 1, wherein the two sub-frames display the same image.

4. The liquid crystal display as claimed in claim 1, wherein each of the first and second look up tables comprises a plurality of gray level pairs, each of the gray level pairs in the first look up tables comprises a gray level corresponding to the frame and a corresponding first predetermined gray level, each of the gray level pairs in the second look up tables comprises a gray level corresponding to the frame and a corresponding second predetermined gray level.

5. The liquid crystal display as claimed in claim 4, further comprising a plurality of sub-pixel regions, wherein the first and second predetermined gray levels of the gray level pairs are respectively obtained by the equation:

$$L = \left(\frac{graylevel}{255}\right)^{\gamma},$$

where L represents a transmittance of light in each of the sub-pixel regions, and γ represents a gamma value of the liquid crystal display.

6. The liquid crystal display as claimed in claim 5, wherein the gray level corresponding to the frames is defined by a corresponding transmittance L1 of light in each sub-pixel region, the first and second gray levels corresponding to the first and second sub-frames are defined respectively by corresponding transmittances L2, L3 of light in each sub-pixel region, and the transmittance L1 is approximately equal to an average of the transmittances L2, L3.

7. A method for driving a liquid crystal display, the method comprising:

doubling a frame rate of signals inputted to a frame buffer of the liquid crystal display by converting each frame into a first sub-frame and a second sub-frame;

reducing a bit number of corresponding signals received from the frame buffer by employing a first look up table and a second look up table, wherein the first look up table converts a gray level of one of the frames into a first predetermined gray level corresponding to the first sub-frame converted from said one frame, the first predetermined gray level corresponding to first signals with the reduced bit number, and the second look up table converts the gray level of said one frame into a second predetermined gray level corresponding to the second sub-frame converted from said one frame, the second predetermined gray level corresponding to second signals with the reduced bit number;

generating third signals with a frequency being half of a frequency of the first signals and fourth signals with a frequency being half of a frequency of the second signals; and driving the liquid crystal display to display images according to the third and fourth signals.

8. The method as claimed in claim 7, wherein each of the first and second look up tables comprises a plurality of gray level pairs, each of the gray level pairs in the first look up tables comprises a gray level corresponding to the frame and a corresponding first predetermined gray level, each of the gray level pairs in the second look up tables comprises a gray level corresponding to the frame and a corresponding second predetermined gray level.

9. The method as claimed in claim 8, wherein the liquid crystal display comprises a plurality of sub-pixel regions, and the first and second predetermined gray levels of the gray level pairs are respectively obtained by the equation:

$$L = \left(\frac{graylevel}{255}\right)^{\gamma},$$

where L represents a transmittance of light in each of the sub-pixel regions, and γrepresents a gamma value of the liquid crystal display.

10. A display device, comprising:

a frame buffer configured to double a frame rate of inputted signals by converting a frame into a first sub-frame and a second sub-frame;

a frame rate conversion circuit configured to reduce a bit number of signals received from the frame buffer, the frame rate conversion circuit comprising:

a first look up table configured to convert each gray level of the frame into a corresponding first predetermined gray level for the first sub-frame, the first predetermined gray level corresponding to first signals with the reduced bit number; and a second look up table configured to convert each gray level of the frame into a corresponding second predetermined gray level for the second sub-frame, the second predetermined gray level corresponding to second signals with the reduced bit number; and a data driver configured to drive the display device to display images corresponding to the frame according to the first signals and second signals;

wherein the display device displays each gray level achieved only by the corresponding first and second predetermined gray levels.

11. The display device as claimed in claim 10, further comprising a data divider, wherein when the data divider receives the first signals from the frame rate conversion circuit, the data divider correspondingly outputs third signals with a frequency being half of a frequency of the first signals to the data driver, when the data divider receives the first signals from the frame rate conversion circuit, the data divider correspondingly outputs fourth signals with a frequency being half of a frequency of the second signals to the data driver.

12. The display device of claim 11, wherein the frame rate conversion circuit further comprises a multiplexer, and the multiplexer is configured to receive the first and second signals, and output the first and second signals to the data divider.

13. The display device as claimed in claim 10, wherein each of the first and second look up tables comprises a plurality of gray level pairs, each of the gray level pairs in the first look up tables comprises a gray level of the frame and a corresponding first predetermined gray level, each of the gray level pairs in the second look up tables comprises a gray level of the frame and a corresponding second predetermined gray level.

14. The display device as claimed in claim 10, further comprising a plurality of sub-pixel regions, wherein the first and second predetermined gray levels of the gray level pairs are respectively obtained by the equation:

$$L = \left(\frac{graylevel}{255}\right)^{\gamma},$$

where L represents a transmittance of light in each of the sub-pixel regions, and γ represents a gamma value of the liquid crystal display.

15. The display device as claimed in claim 10, wherein the gray level corresponding to the frame is defined by a corresponding transmittance L1 of light in each sub-pixel region, the first and second gray levels corresponding to the first and second sub-frames are defined respectively by corresponding transmittances L2, L3 of light in each sub-pixel region, and the transmittance L1 is approximately equal to an average of the transmittances L2, L3.

* * * * *